US005653214A

United States Patent [19]

Lynn

[11] Patent Number: 5,653,214

[45] Date of Patent: Aug. 5, 1997

[54] PIVOTAL BOWSTRING RELEASE MECHANISM

[76] Inventor: Kenneth Lynn, 11906 Creighton Ave., Northport, Ala. 35475

[21] Appl. No.: 653,364

[22] Filed: May 24, 1996

[51] Int. Cl.[6] ..... F41B 5/16; F41B 5/18

[52] U.S. Cl. ..... 124/35.2

[58] Field of Search ..... 124/1, 35.2

[56] References Cited

U.S. PATENT DOCUMENTS

| | | | |
|---|---|---|---|
| 4,426,989 | 1/1984 | Sutton | 124/35.2 |
| 4,509,497 | 4/1985 | Garvison | 124/35.2 |
| 4,831,997 | 5/1989 | Greene | 124/35.2 |
| 5,020,508 | 6/1991 | Greene | 124/35.2 |
| 5,261,581 | 11/1993 | Harden | 124/35.2 X |
| 5,273,021 | 12/1993 | Tepper | 124/35.2 |
| 5,323,754 | 6/1994 | Pittman et al. | 124/35.2 |

*Primary Examiner*—John A. Ricci
*Attorney, Agent, or Firm*—Joseph T. Regard, Ltd.

[57] ABSTRACT

A new and improved release holding mechanism for utilization in conjunction with a wrist strap or the like, the present embodiment configured for utilization in conjunction with a caliper-jaws type release. As configured, the present system contemplates unique pivotal connection between the release extension member and the wrist strap, wherein the user can frictionally pivotally position the release relative to the wrist strap within a wide angular range, and the release will remain in the chosen position until re-positioned. The preferred embodiment of the present system contemplates a release system having first and second ends, a release caliper forming the first end and an angled, threaded connection member forming the second end, a wrist strap having inner and outer sides, with a first connection aperture formed therein, a connector tab situated in pivotal connection to the outer side supporting a grommet having a second connection aperture formed therein situated such that the first and second connection apertures are aligned to allow for the passage of the threaded connection member therethrough. Lastly, a first nut is situated in communication with the threaded connection member, in communication with the inner side of the wrist strap, and a second nut is situated also in communication with the threaded connection member, in communication with the grommet, the first and second nuts having juxtaposed in frictional communication therebetween the wrist strap.

9 Claims, 3 Drawing Sheets

PIVOTAL BOWSTRING RELEASE MECHANISM

TECHNICAL FIELD OF THE INVENTION

This invention relates to bowstring release devices, and in particular to a new and improved release holding mechanism for utilization in conjunction with a wrist strap or the like, the present embodiment configured for utilization in conjunction with a caliper-jaws type release.

As configured, the present system contemplates unique pivotal connection between the release extension member and the wrist strap, wherein the user can frictionally pivotally position the release relative to the wrist strap within a wide angular range, and the release will remain in the chosen position until re-positioned. This ability to selectively position the release relative to the strap provides a new flexibility heretofore not available in releases, allowing the user, for example, to wear the release utilizing the wrist strap, yet position the release in an out of the way position when not in use, yet instantly reposition the release into the use position when ready to utilize same.

Further, the present adjustment mechanism allows the user to position the release when in use in a manner which is more flexible and easier to use and hold, when compared to prior art systems.

The preferred embodiment of the present system contemplates a release system having first and second ends, a release caliper forming the first end and an angled, threaded connection member forming the second end, a wrist strap having inner and outer sides, with a first connection aperture formed therein, a connector tab situated in pivotal connection to the outer side supporting a grommet having a second connection aperture formed therein situated such that the first and second connection apertures are aligned to allow for the passage of the threaded connection member therethrough.

Lastly, a first nut is situated in communication with the threaded connection member, in communication with the inner side of the wrist strap, and a second nut is situated also in communication with the threaded connection member, in communication with the grommet, the first and second nuts having juxtaposed in frictional communication therebetween the wrist strap.

BACKGROUND OF THE INVENTION

While the prior art contemplates various bowstring release configurations, including at least one release wrist strap which permits some limited angular adjustment of the release relative to the strap when in use; however, none are known to particularly teach or contemplate the system of the present invention, which provides for an adjustable pivotal connection between the release mechanism and the wrist strap within a relatively wide angular range.

Caliper-type bowstring releases are not particularly new, and have been around in various configurations for years. The release is typically held by the user, or is secured to the wrist of the user, on the hand which typically pulls back the bowstring. In use, the bowstring release has first and second jaws which close about the bowstring, allowing same to be grasped and pulled by the user. The bowstring release then typically includes a trigger mechanism which, when initiated, evenly and quickly opens the calipers in generally uniform fashion, allowing the immediate release of the bowstring, without interference.

In use, the release must be supported by the user, wherein it must hold back the bow string, which typically may require several tens of pounds of holding pressure. The string is typically gripped by the jaws of the release, which in turn is typically strapped to the user via wrist strap. During use, the actual position of the release relative to the wrist of the user is urged into a various positions, however, typical releases have not compensated for this movement, instead requiring the user to compensate for the release, instead of the release compensating for the user.

Further, traditional releases, not having an adjustable release position relative to the wrist strap, are cumbersome to wear when not actually operating the bow. As, during hunting, one must always be prepared to make the shot, the user is often left with the release occupying one hand, without a means of placing in an out of the way position until needed.

U.S. Pat. No. 4,831,977 issued 1989 to Greene teaches a "Wrist Strap" wherein there is provided a "V-shaped body" which holds the bowstring release in such a manner as to allow some limited pivotal movement, estimated on the order of about a 20 degree angle. Not only is this believed to be too limited a range to be of any substantive use in the manner contemplated in the present invention, but also the '977 system does not teach a structure which provides a means of holding the pivoted release in the desired adjusted pivotal angle; instead, if the user desires to adjust the '977 release in pivotal fashion (within the limited range supra), the user must hold said position manually, which is of little use in the present contemplated invention.

Thus, while the prior art may have contemplated in some limited context a release structure which allows some limited pivotal movement relative to the wrist strap, none are known to have contemplated a system wherein there is provide a wide angular range of movement between the wrist strap and the release, coupled with means to retain the release in the adjusted position.

GENERAL SUMMARY DISCUSSION OF THE INVENTION

Unlike the prior art, the present invention provides a pivotal bowstring release mechanism which is easily and effectively implemented, and is inexpensive to manufacture and maintain.

As configured, the present system contemplates unique pivotal connection between the release extension member and the wrist strap, wherein the user can frictionally pivotally position the release relative to the wrist strap within a wide angular range, and the release will remain in the chosen position until re-positioned. This ability to selectively position the release relative to the strap provides a new flexibility heretofore not available in releases, allowing the user, for example, to wear the release utilizing the wrist strap, yet position the release in an out of the way position when not in use, yet instantly re-position the release into the use position when ready to utilize same.

Further, the present adjustment mechanism allows the user to position the release when in use in a manner which is more flexible and easier to use and hold, when compared to prior art systems.

The preferred embodiment of the present system contemplates a release system having first and second ends, a release caliper forming the first end and an angled, threaded connection member forming the second end, a wrist strap having inner and outer sides, with a first connection aperture formed therein, a connector tab situated in pivotal connection to the outer side supporting a grommet having a second connection aperture formed therein situated such that the first and second connection apertures are aligned to allow for the passage of the threaded connection member therethrough.

Lastly, a first nut is situated in communication with the threaded connection member, in communication with the inner side of the wrist strap, and a second nut is situated also in communication with the threaded connection member, in communication with the grommet, the first and second nuts having juxtaposed in frictional communication therebetween the wrist strap.

It is therefore an object of the present invention to provide a system for pivotally adjusting a bowstring release mechanism relative to a supporting wrist strap, holder or the like.

It is another object of the present invention to provide an adjustable bowstring release mechanism which is readily adjustable by the end user by hand.

It is still another object of the present invention to provide a system for adjusting the angular relationship of a bowstring release relative to a wriststrap, holder or the like, wherein the release is held in position after adjustment, until re-adjusted by the user.

It is another object of the present invention to provide a system for pivotally adjusting a release mechanism relative to a wriststrap, holder or the like, which is relatively inexpensive to manufacture, and which is easy to use.

Lastly, it is an object of the present invention to provide a system pivotally adjusting a bowstring release relative to a wriststrap, holder or the like, wherein the user is able to angularly position the release relative to the wriststrap during an arrow firing sequence using a bow, and is able to thereafter position the release in an out of the way position, fleeing the user's hand for other activities while retaining the wriststrap about the wrist of the user.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
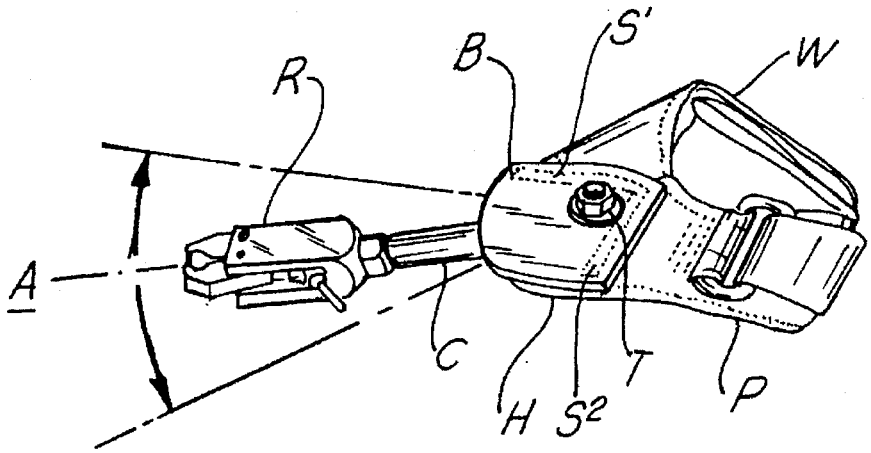
FIG. 1 (PRIOR ART)
FIG. 1 is an isometric view of an exemplary prior art release mechanism, illustrating the,limited pivotal movement of the release relative to the wriststrap.

FIG. 1 illustrates a prior art device P, illustrating a release R affixed to a wriststrap W via a connector extension C, which is affixed to "V-shaped body" B which holds the bowstring release in such a manner as to allow some limited pivotal movement, estimated on the order of about a 20 degree angle.

As shown, the body B is of a generally triangular configuration, with first and second edges sewn S', S", respectively to a holding area H of the wriststrap, forming an open edge and enveloping flap area formed between the body B and the holding area of the wriststrap.

The connector extension C passes between the open edge of the body B and the holding area H, and is diverted outwardly through an aperture formed in the body B, where it is secured via threaded connector T. As shown, this arrangement allows for some limited angular adjustment A, but only with a very limited range, and only remains in the adjusted position as long as it is manually held in place; thereafter, the release is urged generally towards the centerline because as the connector extension C is urged towards the sewn areas S', S", it tends to be pinched between the body B and holding areas H, which are conjoined at the sewn areas S', S".

Not only is this arrangement believed to offer too limited an angular range of movement to be of any substantive use in the manner contemplated in the present invention, but also this system does not teach a structure which provides a means of holding the pivoted release in the desired adjusted pivotal angle; instead, if the user desires to adjust the release of FIG. 1 in pivotal fashion (within the limited range supra), the user must hold said position manually, which is of little use in the present contemplated invention.

Thus, while the prior art may have contemplated in some limited context a release structure which allows some limited pivotal movement relative to the wrist strap, none are known to have contemplated a system wherein there is provide a wide angular range of movement between the wrist strap and the release, coupled with means to retain the release in the adjusted position.

Figure 2:
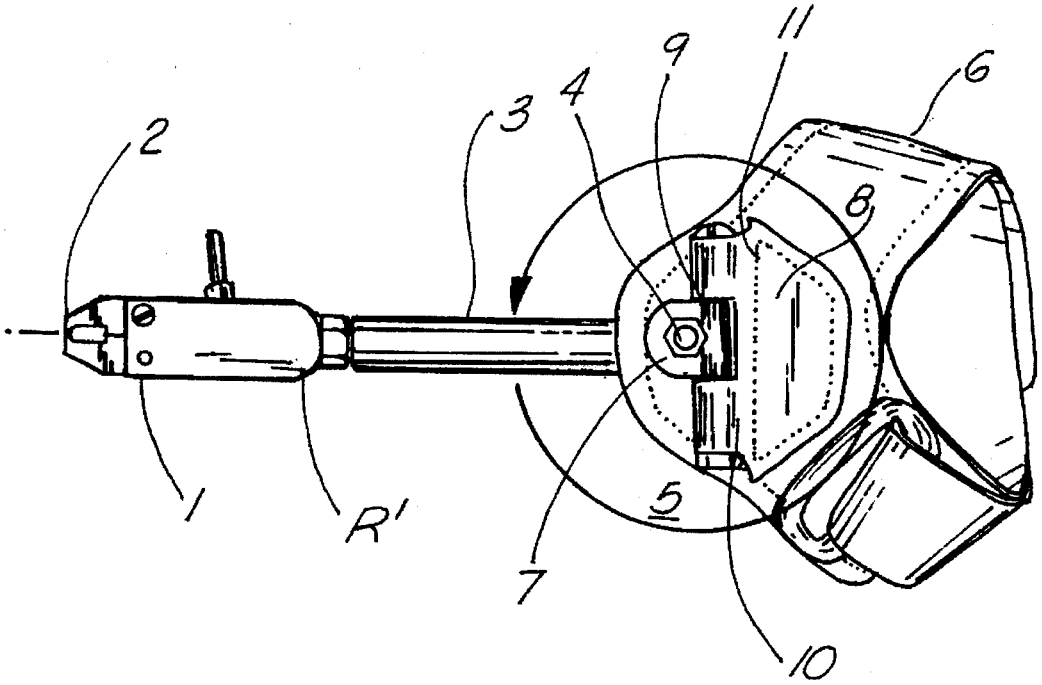
FIG. 2 is a top view of the pivotal bowstring release mechanism, illustrating the wise range of pivotal adjustment afforded the present invention, as well as the general structural configuration of said system.

FIG. 2 illustrates the preferred embodiment of the present invention. The preferred embodiment of the present system contemplates a release system having first and second ends, a release caliper forming the first end and an angled, threaded connection member forming the second end, a wrist strap having inner and outer sides, with a first connection aperture formed therein, a connector tab situated in pivotal connection to the outer side supporting a grommet having a second connection aperture formed therein situated such that the first and second connection apertures are aligned to allow for the passage of the threaded connection member therethrough.

Lastly, a first nut is situated in communication with the threaded connection member r, in communication with the inner side of the wrist strap, and a second nut is situated also in communication with the threaded connection member, in communication with the grommet, the first and second nuts having juxtaposed in frictional communication therebetween the wrist strap.

Figure 3:
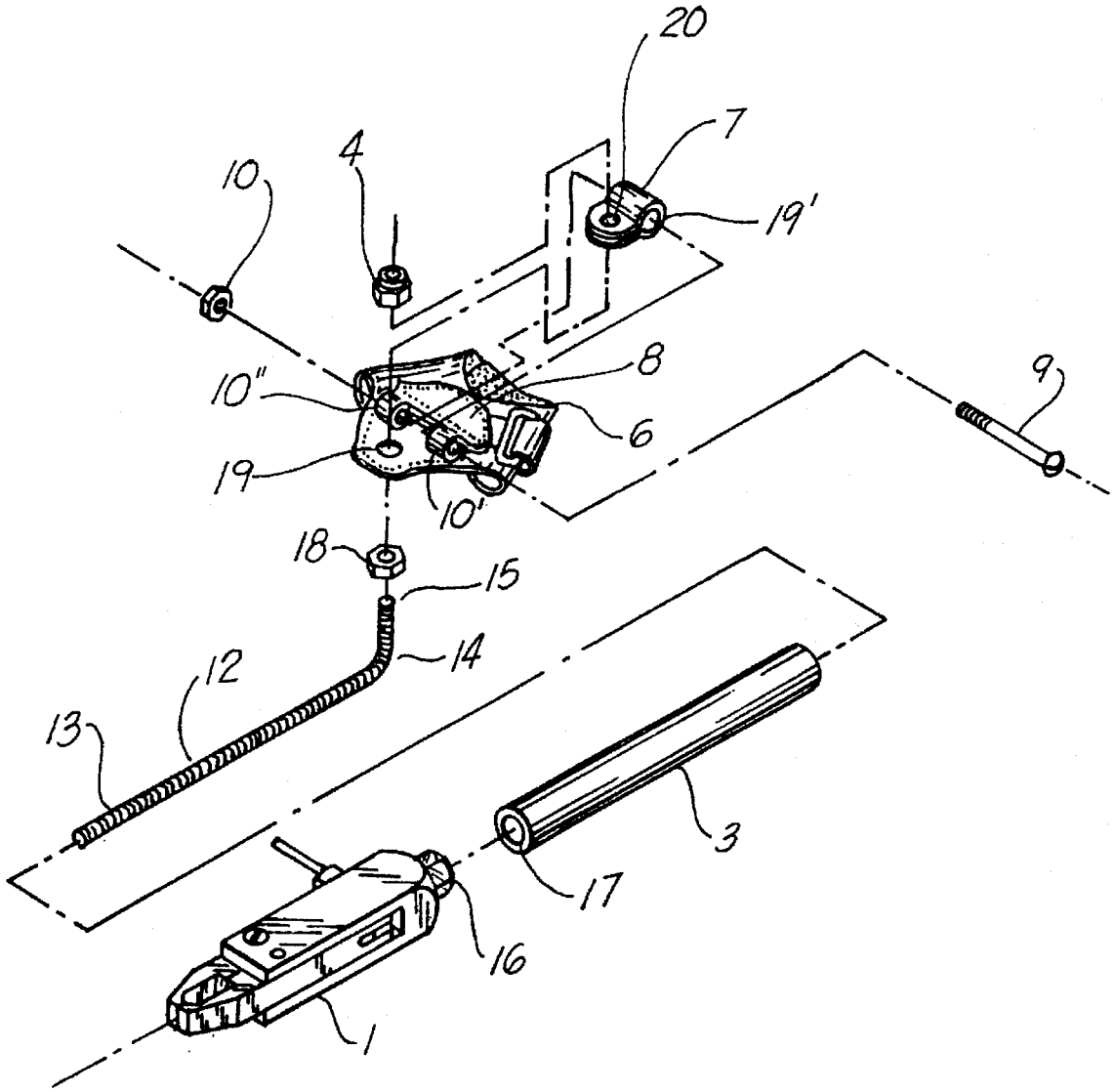
FIG. 3 is an exploded view of the pivotal bowstring release mechanism of the present invention, illustrating the various components of the pivotal connection between the release strap, and their position and interaction therebetween.

Continuing with FIGS. 2 and 3, the release of the present invention R' includes a caliper release mechanism 1 having caliper jaws 2 formed at its first end, and a holding/extension member 3 at its second end, the holding extension member pivotally connected via threaded connection 4 to a wriststrap 6, which is reinforced via grommet 7, which in turn is secured to a tab 8 sewn to wriststrap, the grommet secured to the tab via pin or screw 9. The tab 8 is folded over prior to sewing 11 same, forming a passage 10 for passage for pin or screw 9 for retaining the grommet in place. Because the connection of the present invention is not between two flaps in the manner contemplated by the prior art above, the angular displacement is greatly increased; further, the invention as taught allows for angular adjustment of the release R' relative to the wriststrap 6 which remains as set, as opposed to a loose pivotal connection.

FIG. 3 provides a more detailed, exploded view of the various elements forming the present invention, with assembly lines indicating how they are conjoined. As shown, the straight area of a threaded connection piece 12 is configured to pass through a longitudinal passage 17 formed through the holding extension member 3, wherein the first end 13 of the connection piece is joined to the caliper mechanism 1 via threaded connection member 16.

The threaded connection piece 12 further includes an angled area 14 generally adjacent to the second end 15, forming an angle of, for example, generally about ninety degrees, such that the second end of the preferred embodiment is of a generally lateral position relative to longitudinal axis of the connection piece 12, forming a lateral connection area which is not generally covered by the holding extension member 3, and which passes adjacent to the underside of the wrist strap 6. A nut 18 may be threadingly connected to the lateral connection area of the connection piece 12, such that a portion of the threaded connection area is still exposed at its second end, enabling the exposed thread connection area adjacent to the second end to pass through an aperture 19 formed in the strap, as well as a passageway 20 formed in grommet 7, where it is finally held in place via nut forming a threaded connection 4, wherein the grommet 7 and the strap 6 are effectively sandwiched between nut 18 and nut forming threaded connection 4, which both may threadingly adjusted to provide a frictionally secured, pivotal relationship. If desired washers of NYLON or the like may be provided along the threaded connection sandwiching the grommet and/or wrist strap, providing smooth pivotal adjustment of the release relative to the wriststrap, while allowing some retention of the desired position until readjustment.

As further shown, the grommet 7 is configured to reinforce the connection between the threaded connection member 12 and the wrist strap, and thus further has a connection passage 19' formed in lateral fashion relative to passageway 20. The passageway allows passage of a pin or screw 9, for securing the grommet to the wrist strap via passages 10', 10" formed in flap 8.

Figure 3A:
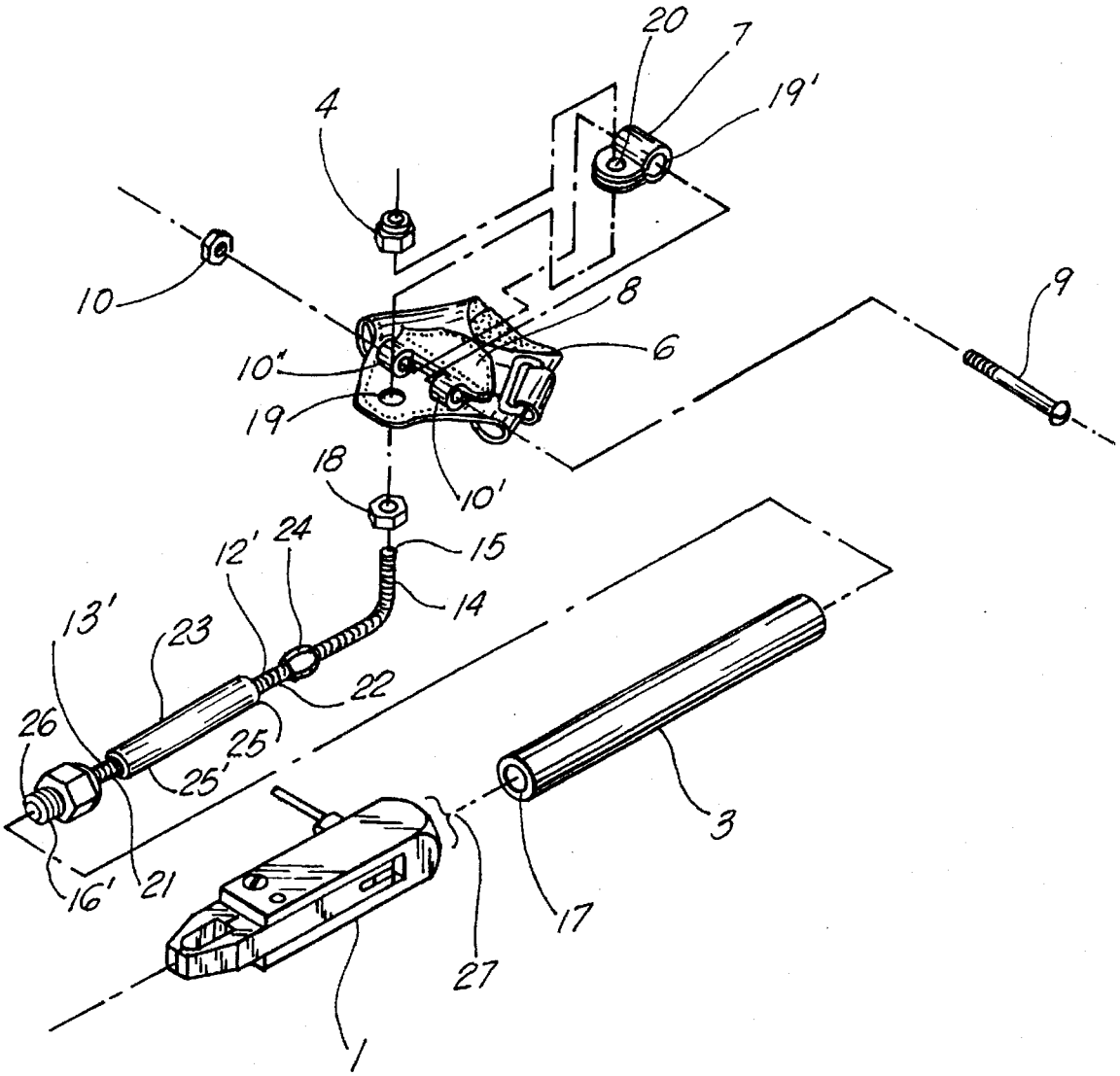
FIG. 3A illustrates a preferred embodiment of the pivotal bowstring release of the present invention, illustrating an adjustable length embodiment.

As further shown in FIG. 3A, an release mechanism having an adjustable extension member may be provided, allowing for customized setup for the individual, improving comfort, usability, and accuracy.

As shown, the extension member 12' is cut in the medial area, forming first 21 and second 22 pieces, each said pieces engaging opposing threaded ends of an adjustment member 23 having a threaded bore formed therethrough. Thus, the length of the threaded connection member may be varied by threading said member into or out of said threaded bore, and locking the adjusted position via lock nut, which would threadingly engage and be tightened upon the first end 25 of said adjustment member.

As shown, the end 13' of the first piece 21 of extension member may threadingly engage threaded connection member 16', and be tightened to form a locking arrangement. In turn, said threaded connection member 16' may include an opposing male threaded member 26, which would engage a female threaded bore 27 formed in the release mechanism, or visa-versa.

An alternative embodiment may include a threaded connection member 26, wherein there is provided a male threaded member 26 at one end, and a smaller diameter male threaded member fixedly attached, and projecting from the opposing end, said smaller diameter male threaded member configured to engage the second end 25' of said adjustment member 23.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A bowstring release system, comprising:

a release mechanism having first and second ends, said release mechanism having a bowstring release caliper situated at said first end, an angled connection member having a base and an end forming said second end, and an extension piece situated between said release caliper and said angled connection member;

a wrist strap having inner and outer sides, with a first connection aperture formed therethrough;

reinforcement means associated with said outer side of said wrist strap, said reinforcement means comprising a support piece having a second connection aperture formed therethrough, said second connection aperture aligned with said first connection aperture formed in said wrist strap;

said extension piece situated adjacent to said inner side of said wrist strap, such that said angled connection member passes through the first and second connection apertures formed in said wrist strap and reinforcement means, respectively;

pivotal connection means associated with said end of said angled connection member, said connection means configured to retain said angled connection member through the first and second connection apertures formed in said wrist strap and reinforcement means, respectively, said pivotal connection means further configured to frictionally clamp said extension piece to said wrist strap in such a manner as to provide pivotal adjustment, while retaining said extension piece in the adjusted position.

2. The invention of claim 1, wherein said reinforcement means comprises a grommet having formed therein a first connection aperture in alignment with said aperture formed in said wriststrap, said grommet further having formed therein a second connection passage formed in lateral relationship to the first connection aperture.

3. The invention of claim 2, wherein said outer side of said wriststrap further comprises a connector tab configured to engage said grommet via a connector piece passing through said second connection passage formed in said grommet.

4. The invention of claim 3, wherein said connector tab has formed therein first and second connection passages situated in general alignment with the second connection passage formed in said grommet, and said connector piece further passes through the first and second connection passages formed in said connector tab.

5. The invention of claim 1, wherein said angled connection member is situated at about a ninety degree angle relative to said extension member.

6. The invention of claim 1, wherein said end of said angled connection member is threaded, and said pivotal connection means comprises a threaded nut.

7. The invention of claim 6, wherein said pivotal connection means further comprises a second threaded nut situated adjacent to said base of said angled connection member.

8. The invention of claim 6, wherein said pivotal connection means further comprises a washer situated adjacent to said base of said angled connection member.

9. The invention of claim 1, wherein said extension piece further comprises an adjustment member having a threaded bore formed longitudinally therethrough, said extension piece configured to threadingly engage said longitudinal bore formed in said adjustment member so as to vary the effective length of said extension piece.

* * * * *